United States Patent [19]

Heininger et al.

[11] 4,356,593

[45] Nov. 2, 1982

[54] SAFETY LATCH COVER FOR A HINGE JOINT

[75] Inventors: Richard T. Heininger, Gardner, Mass.; Benjamin K. Burnham, Merrimack, N.H.

[73] Assignee: Gem Industries, Inc., Gardner, Mass.

[21] Appl. No.: 308,986

[22] Filed: Oct. 6, 1981

[51] Int. Cl.[3] ..... E05D 5/02

[52] U.S. Cl. ..... 16/251; 5/57 B

[58] Field of Search ..... 16/250, 251, 223; 5/99 R, 99 A, 99 B, 99 C, 100, 57 R, 57 B, 57 C, 57 D, 57 E

[56] References Cited

U.S. PATENT DOCUMENTS

| | | | |
|---|---|---|---|
| 1,457,232 | 5/1923 | Sheney | 5/57 R |
| 2,254,939 | 9/1941 | Elias | 5/99 R |

FOREIGN PATENT DOCUMENTS

| | | | |
|---|---|---|---|
| 1099900 | 2/1961 | Fed. Rep. of Germany | 16/251 |
| 13504 | of 1902 | United Kingdom | 5/57 B |
| 2061099 | 5/1981 | United Kingdom | 5/99 R |

*Primary Examiner*—Henry Jaudon
*Assistant Examiner*—Andrew M. Falik
*Attorney, Agent, or Firm*—Charles R. Fay

[57] ABSTRACT

A hinge construction comprising two members, a plate on each member, an offside out-of-the-way hinge, and a substantially recess and aperture free pivoted channel safety cover to protect the area of abutment of the two members when in such position.

6 Claims, 3 Drawing Figures

SAFETY LATCH COVER FOR A HINGE JOINT

BACKGROUND OF THE INVENTION

Particularly in folding infant furniture, e.g. cribs, it is of course necessary to have hinges. It is also necessary to prevent the child's fingers from being pinched in any way and although pivoted guard covers for such hinges have been suggested in the past these have had deficiencies in relation to the design thereof which allow, to some degree, pinching of the fingers or injury to the child's hand.

SUMMARY OF THE INVENTION

In a hinge joint say for instance for the rails or end portions of cribs where the hinges are opened in order to fold the parts, a new and improved safety hinge comprising a plate on the side of each abutting end piece to be folded, each plate being provided with a bent out tab located at the bottom of the hinge member and being pivoted together. For this reason it is then possible to provide a U-shaped guard cover which is pivoted to one of the members to release the hinge to allow the structure to be folded, or to cover the hinge completely without cuts, folds, or indentations of any kind in the U-shaped cover, so that therefore it is not possible for the occupant to get his or her fingers in such opening, indentation, etc.

PREFERRED EMBODIMENT OF THE INVENTION

Figure 1:
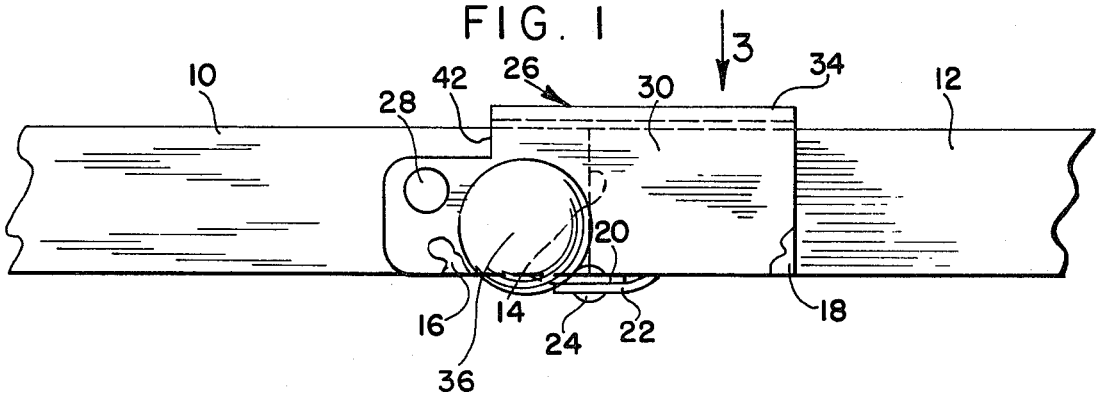
FIG. 1 is a view in side elevation showing the safety latch cover in active position.

There are two elongated members 10 and 12 which may be placed in line or extended condition thereof substantially abutting each other along a line at 14 and it is intended to provide a hinge for these members so that they can be swung into a side by side relationship as for instance in a folding crib or similar article of child's furniture.

The hinge between the two members 10 and 12 includes a plate 16 on member 10 adjacent to the line at 14 and a similar plate 18 on member 12. These members are provided with right angle bent up tabs 20 and 22 which are pivoted together as at 24 by any means desired. This pivot allows the two members 10 and 12 to be pivoted around into side by side relation.

Figure 2:
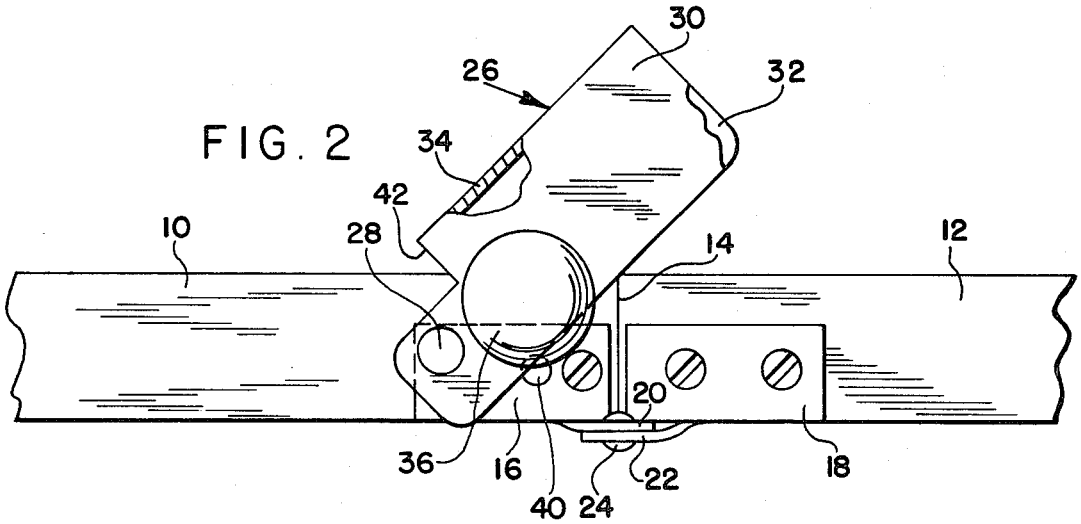
FIG. 2 is a similar view showing the safety cover pivoted to a position wherein the two pivoted members are released.
Figure 3:
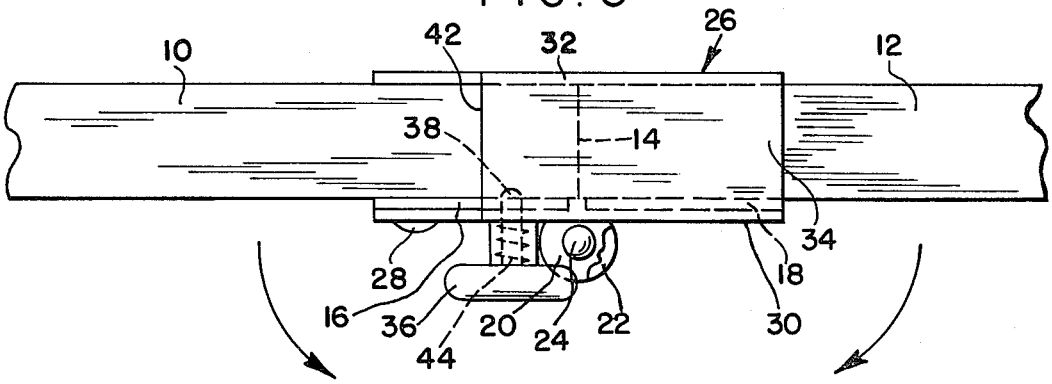
FIG. 3 is the plan view looking in the direction of arrow 3 in FIG. 1.

A generally channel shaped elongated cover member generally indicated at 26 is provided with a pivot 28 which is pivoted to plate 16. It comprises two parallel spaced side plates 30, 32 and a top member 34, plate 30 having a spring pressed button 36 with a latching member 38 extending into for instance a hole 40 in plate 16 when it is in its FIGS. 1 and 3 position holding the parts together. The hole 40 is closely adjacent pivot 28 on the pivoting side of the device. It will be seen that the top plate 34 overlies the end edges 14 of the two members 10 and 12, and when latched as in FIGS. 1 and 3, protects a child from getting fingers caught between the ends of the members 10 and 12. The prior art deficiency of having a cutaway portion to accommodate a hinge and pintle is done away with and the only cutout portion for the U-shaped member resides in the cutout at 42 to accommodate the cover 26 so that it can be pivoted from the FIG. 1 to the FIG. 2 position. When in the FIG. 2 position, the members 10 and 12 may pivot in towards each other as shown by the arrows in FIG. 3.

The button 36 is generally conventional with a spring 44 urging the latching member 38 to latched condition and requiring a pull to release. Together with the close positioning of pivot 28 and latching hole 40, the latching member 38 engages in hole 40 automatically when the cover is returned to normal or closed position as in FIG. 1. By this single motion, the cover is double locked, i.e., it requires a pull on the button 36 and a swing up of the cover to release the members 10 and 12 and thereby allow the folding action.

We claim:

1. A safety hinge construction for a pair of members adapted to be located in extension of each other or selectively in a side by side relation, comprising a plate on each member adjacent the adjacent ends thereof, said plates being generally alike, an outstanding tab on each plate, said tabs being located at right angles with respect to the plates and at one side of the two members, said tabs being superposed, means pivoting said tabs together and providing for pivoting the two members from extended condition to the side by side relation, a latching cover for the adjacent ends of said members, said cover comprising a generally channel shaped element, means pivoting the same to one of said plates, said channel shaped element including spaced legs straddling the members and covering the area of abutment of said members, and a spring pressed catch on one of said legs to secure the members in latched condition.

2. The safety hinge construction of claim 1 wherein said cover has only one visible cutout portion to accommodate the swinging motion of the cover.

3. A hinge construction comprising a pair of elongated members adapted to be located in an extended end butting relation or selectively in a side by side relation, a plate on each member adjacent the corresponding ends thereof, a tab on each plate, said tabs being superposed and extending laterally of the plates to one side of the members leaving said plates unencumbered while at the same time pivoting the members together, a safety guard to cover the abutting area of said members when in extended position, said safety guard cover comprising an elongated channel-like element, means pivoting the same to one of said plates adjacent to an edge thereof and having a position of use covering said area of abutment and a retracted position where the abutment area of said members is free so that the members can be pivoted into a side by side relation, and a spring catch holding the channel-like element in locked covering condition with respect to said elongated members when in extended condition thereof.

4. The hinge construction of claim 3 wherein said channel-like element is substantially free of recesses except for a provision for allowing the element to pivot.

5. The hinge construction of claim 3 wherein the means pivoting the cover to the said one plate is closely adjacent the spring catch.

6. The hinge construction of claim 5 including means on the one plate to receive the spring catch.

* * * * *